United States Patent [19]

Nurney

[11] Patent Number: 5,040,520

[45] Date of Patent: Aug. 20, 1991

[54] LIMB TIP CAM PULLEY FOR HIGH ENERGY ARCHERY BOW

[76] Inventor: David J. Nurney, 12213 Densmore Ave. N., Seattle, Wash. 98133

[21] Appl. No.: 160,543

[22] Filed: Feb. 25, 1988

Related U.S. Application Data

[62] Division of Ser. No. 438,204, Nov. 1, 1982, Pat. No. 4,739,744.

[51] Int. Cl.[5] ..... F41B 5/10

[52] U.S. Cl. ..... 124/25.6; 124/900

[58] Field of Search ..... 124/23 R, 86, DIG. 1, 124/24 R, 88, 25.6, 900, 23.1, 24.1

[56] References Cited

U.S. PATENT DOCUMENTS

| | | | |
|---|---|---|---|
| 3,486,495 | 12/1969 | Allen | 124/24 R |
| 3,851,638 | 12/1974 | Alexander | 124/24 R |
| 3,923,035 | 12/1975 | Trotter | 124/24 R |
| 3,958,551 | 5/1976 | Ketchum | 124/24 R |
| 4,060,066 | 11/1977 | Kudlacek | 124/23 R |
| 4,201,177 | 5/1980 | Holman et al. | 124/23 R |
| 4,202,316 | 5/1980 | Barna | 124/24 R |
| 4,241,715 | 12/1980 | Jennings | 124/24 R |
| 4,368,718 | 1/1983 | Simonds et al. | 124/23 R |
| 4,478,203 | 10/1984 | Hayes | 124/88 X |
| 4,519,374 | 5/1985 | Miller | 124/23 R |
| 4,739,744 | 4/1988 | Nurney | 124/23 R |
| 4,748,962 | 6/1988 | Larson | 124/23 R |

*Primary Examiner*—Peter M. Cuomo

*Attorney, Agent, or Firm*—Robert W. Beach; Ward Brown

[57] ABSTRACT

Composite bowstring and take-up string cam pulleys are carried by the tip portions of a compound archery bow limbs extending oppositely substantially symmetrically from a handle with the bowstring connecting the composite cam pulleys and take-up strings extending from each composite pulley to the opposite bow limb. Each composite cam pulley is composed of a generally elliptical bowstring pulley section having a major axis passing through its portions of substantially greatest length and a generally elliptical take-up string pulley section having a major axis passing through its portion of substantially greatest length, which pulley sections are integrated in parallel side by side relationship with planes containing their major axes substantially perpendicularly intersecting. The effective bowstring lever arm of the bowstring pulley section is small and substantially constant during increase of the draw force to at least 90 percent of the maximum draw force while the bowstring nocking point is displaced less than 40 percent of the total displacement during draw and the bowstring lever arm then increases substantially linearly while the draw force remains at a substantially constant maximum value over at least a third of the total bowstring nocking point displacement during draw of the bowstring. The ratio of bowstring draw arm to take-up string draw arm is substantially constant during the draw force increasing phase of the draw.

33 Claims, 6 Drawing Sheets

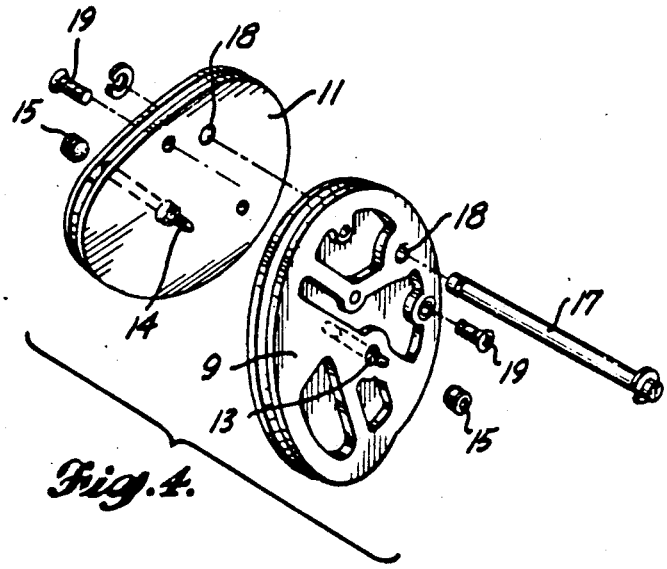
Fig. 4.
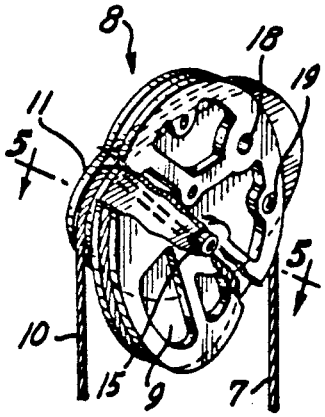
Fig. 3.
Fig. 5.
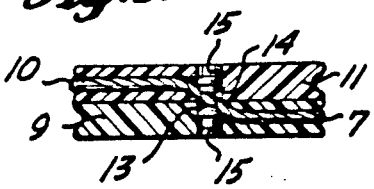
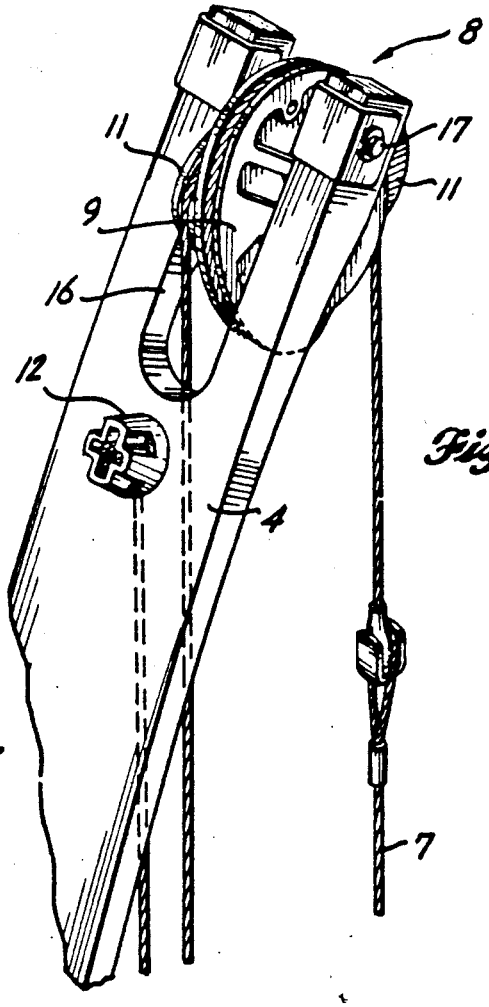
Fig. 2.
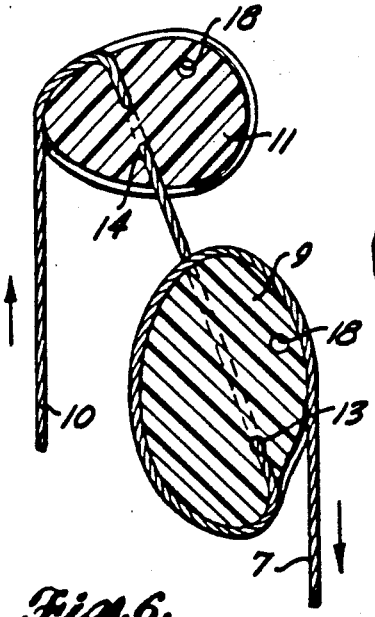
Fig. 6.

D=0"
R=0°
B=0.6
T=4.2
B/T=0.143

D=6.8"
R=37°
B=0.7
T=4.4
B/T=0.16

D=8.8"
R=56°
B=1.6
T=4.25
B/T=0.38

D=17.8"
R=162°
B=4.3
T=2.5
B/T=1.72

D=23.8"
R=253°
B=3.0
T=0.9
B/T=4.22

LIMB TIP CAM PULLEY FOR HIGH ENERGY ARCHERY BOW

This is a divisional of co-pending application Ser. No. 438,204 filed on Nov. 1, 1982, now U.S. Pat. No. 4,739,744.

BACKGROUND OF THE INVENTION

1. Field of the Invention

This invention relates to limb tip cam pulleys for a compound archery bow and more particularly to cam pulleys mounted on the tips of the bow limbs engaged by the bowstring and take-up strings which cam pulleys are designed for high energy operation of the bow.

2. Archery Bow Action

Drawing of an archery bowstring by an archer effects bending of resilient bow limbs extending oppositely from a grip in opposition to their bias to straighten. Such bending of the bow limbs produces a storage of potential energy in the stressed bent bow limbs which upon release of the bowstring unflexes the bow limbs to straighten the bowstring which is in engagement with the nock of the arrow. Such straightening of the bowstring from bent position drives the arrow. The greater the force required to bend the bow limbs to a given degree and the greater the degree of bend, the more potential energy will be stored in the bow limbs. Consequently, the greater will be the energy available for driving the arrow when the bowstring is released and the greater will be the acceleration and resultant speed of the arrow so that it will travel a greater distance and/or will strike a target with greater force.

The amount of potential energy that is stored by the bent bow limbs is related directly to the amount of force that is required to draw the bowstring back and the distance that the bowstring is pulled. The greatest potential energy would be produced if the maximum draw force which a particular archer is capable of exerting were maintained constant at all stages of the draw, but various considerations make such a constant draw force throughout the entire extent of the bowstring nocking point draw displacement impractical and undesirable.

In a longbow in which the opposite ends of a bowstring are fixedly attached to the ends of two bow limbs that are substantially symmetrical about the bow grip, the draw force increases progressively as the bowstring is drawn, so that at full or maximum draw the draw force also is maximum. Since the arrow must be sighted when the bow is fully drawn, the requirement for maximum draw force at the maximum draw distance severely limits the power of the bow that longbow archers could shoot comfortably and accurately.

Various types of compound bow have been devised, a particular objective of all of which is to provide a bow construction enabling the bow to be held at full draw of the bowstring by a force less than the force required to be exerted on the bowstring at some intermediate point in the draw to reach full draw position. Different types of bows have different draw force requirements for drawing the bowstring from the position of rest to the fully drawn position.

3. Prior Art

An early compound bow enabling the bowstring to be held in fully drawn position by exerting on it a force less than the force required at an intermediate position of the draw is disclosed in Allen U.S. Pat. No. 3,486,495. The bow of this patent used pulleys pivotally mounted on the tips of flexible bow limbs which pulleys were engaged by the bowstring and by take-up strings extending from a pulley on one limb tip to an anchor on the other limb tip. In one instance, the pulleys were generally of oval profile and in a modification the pulleys were circular. In both instances the pulleys were journaled at a location offset from the center of the geometric shape. In both instances the pulleys had two pulley components disposed in registration, one for the bowstring and the other for a take-up string, and both pulley components were of substantially the same configuration.

Curves plotting draw force as ordinates and bowstring nocking point draw displacement as abscissae portrayed a generally hyperbolic curve in which the force required to draw the bowstring during initial displacement of the nocking point increases rapidly, as the intermediate position is approached the required force increases less rapidly until a maximum is reached at approximately mid draw, and the draw force then decreases until full draw is reached so that the maximum force applied by the archer to the bowstring will not be required to hold the bowstring in the fully drawn position. The Allen bow is stated to have an increase in energy over the longbow without increasing the length of the draw or the holding force required in the fully drawn position.

An archery bow generally similar to the bow of Allen U.S. Pat. No. 3,486,495 is disclosed in U.S. Pat. No. 4,060,066 of Kudlacek. This patent states that previous compound bows had utilized paired cam elements with their cam elements concentrically joined together, whereas in the Kudlacek bow each cam member comprised dual cam elements secured together eccentrically. Each of the cam elements is in the form of a circular pulley provided with a single peripheral guide groove. Use of such eccentrically mounted cam elements operated to provide a draw force or weight which varied with the extent of the draw. The patent compares the operation of its bow with those of prior compound bows having concentrically mounted circular cam elements and points out that by utilizing circular cams of different size in which the pivot of the cam of one size is offset from the pivot of the cam of the other size, the maximum draw force point for the Kudlacek patent bow occurs earlier in the draw although the maximum draw force is approximately the same. Such feature of having the maximum draw force occur at approximately 2 inches (5 cm) less draw displacement is stated to be especially advantageous for persons having short arms. Also, the draw force to draw distance curve is flatter in the full draw region making it easier for the archer to arrive at and maintain full draw during sighting and shooting.

The Kudlacek patent points out that the total area under the draw force curve is greater for the Kudlacek bow than for the prior art bow, presumably the bow of Allen U.S. Pat. No. 3,486,495, representing greater total potential energy and consequently providing greater arrow speed with increased accuracy and distance.

The later Barna, U.S. Pat. No. 4,202,316 discloses an archery bow of the same general type as shown in Allen, U.S. Pat. No. 3,486,495 and in Kudlacek, U.S. Pat. No. 4,060,066, but, in this instance, the pulley means mounted on each bow limb tip includes only a single pulley of circular profile which is pivoted eccentrically. Each pulley includes sockets on its outer circumference engageable by beads on the bowstring.

Such beads prevent the bowstring from slipping on the pulley. A particular object of the bow of this patent is to mount the bowstring on the pulleys in a manner which removes the bowstring from contact with the fletching of a released arrow without subjecting the limbs of the bow to a torque. Also, the draw force and draw length of the bow are adjustable by altering the length of the flexible string portion to move the limb free end portions toward or away from each other.

A still later patent disclosing the same general type of compound archery bow is Jennings, U.S. Pat. No. 4,241,715. The pulley means mounted on the tips of the bow limbs in this instance are eccentric circular pulleys. Each pulley means includes a larger circular pulley and a smaller circular pulley that are fixed in concentric relationship and which composite pulley is pivotally mounted for turning about an axis offset from the center of the pulleys. While the two pulley components of each composite pulley are shown as being of different size, Jennings states that the diameters of the two components may be the same.

The string passes diagonally through the Jennings composite pulley from one circular pulley section to the other. The position of the string passage enables the draw length and draw force of the bow to be adjusted. This patent is not concerned with the relationship between the draw force and the degree of bowstring nocking point draw displacement at different phases of the draw.

None of the Allen, Kudlacek, Barna and Jennings patents is particularly concerned about providing a bow that will store the greatest practical amount of potential energy while being drawn with a given maximum drawing force. The Allen U.S. Pat. No. 3,486,495 states that the bow of that patent requires the archer to apply added force at the commencement of the draw to effect an increased energy buildup so that at full draw greater energy will be imparted to the limbs although a lesser force is required to hold the bowstring.

The Alexander U.S. Pat. No. 3,851,638 discloses a compound bow different from the general type shown in Allen, U.S. Pat. No. 3,486,495, Kudlacek, U.S. Pat. No. 4,060,066, Barna, U.S. Pat. No. 4,202,316, and Jennings, U.S. Pat. No. 4,241,715. The bow of this patent also, however, is concerned with providing a leverage system which will enable the bow to be held more easily in fully drawn position while being aimed, which was an objective of the Allen U.S. Pat. No. 3,486,495. The Alexander patent states at column 4, lines 58 to 64, "as the bowstring is drawn back, the combined actions of the bowstring and the power cams produce an increase in leverage, reducing the amount of force required to draw the bow. The draw force diminishes steadily from a maximum at the rest point of bowstring 44 to a minimum at the fully drawn position." The Alexander bow thus allows an archer to use a more powerful bow than a longbow because the maximum pull is required at the start of the draw where the archer's hands are close together and he is able to exert maximum leverage instead of at the end of the draw when one arm is highly flexed. Such a bow, however, does not produce maximum energy because of the steady decrease in force required to draw the bow as the degree of draw progresses.

A different type of compound archery bow is disclosed in Trotter, U.S. Pat. No. 3,923,035. Trotter states that an object of his invention is to provide a compound bow in which the bowstring tension initially sharply increases at the beginning of the draw to a maximum design tension, and this maximum tension is maintained until full draw of the bow is approached, at which point the maximum design tension drops to an optimum design holding tension at full draw. It is pointed out that various compound bow designs had been proposed in order to achieve the combination of a powerful arrow propulsion system and optimum bowstring tension at full draw. The Trotter bow is, however, much more complicated than the compound bows of the Allen, Kudlacek, Barna and Jennings patents discussed above.

OBJECTS OF THE INVENTION

It is the principal object of the present invention to provide bowstring and take-up string cam pulleys for a compound archery bow capable of storing nearly maximum potential energy while enabling the bowstring to be held at full draw with reduced force and to use a compound bow pulley means engageable with the bowstring and take-up strings which are carried by the tips of the limbs of a generally symmetrical bow.

More particularly, it is an object to provide pulley means pivotally mounted on the bow limb tips of a character which will produce a rapid increase initially in the force required to draw the bowstring, the increasing force will change abruptly to a maximum required force which will remain generally constant over a large portion of the bowstring draw displacement distance and which force will then decrease sufficiently to facilitate holding of the bow at full draw while the arrow is being aimed.

In accomplishing the foregoing objects, it is a further object to utilize pulley structures of simple and effective design.

Another object is to insure maintenance of engagement between the strings and the pulley means throughout the draw.

It is also an object to provide pulley means having a contour which will enable the strings to wrap around the pulleys smoothly at all times without a string slapping its pulley to produce objectionable noise.

A further object is to enable the potential energy stored in the bent limbs of a compound bow to be transformed quickly into kinetic energy in the straightening of the bowstring and driving of the arrow to utilize the stored energy most effectively for arrow propulsion.

An additional object is to provide a bow that can be set up easily and tuned for noncritical and accurate shooting and is not sensitive to slight nonsynchronous turning of the pulley means on the two bow limbs.

SUMMARY OF THE INVENTION

The present invention utilizes pulley means mounted on the tips of bow limbs extending oppositely substantially symmetrically from a handle, with which pulley means are engaged a bowstring extending between them and take-up strings extending from the pulley means carried by the tip portion of each bow limb to the tip portion of the other bow limb. Each pulley means has integral dual nonsymmetrical, noncongruent bowstring and take-up string pulley sections and is mounted on its limb tip portion for free turning on pivot means offset a substantial distance from the central portion of both pulley sections. The dual pulley sections carried by the opposite bow limb tips correspond in profile, one being the mirror image of the other. The take-up string and the bowstring are sections of the same string which passes through the pulley means unbroken and is secured to the pulley means to prevent slippage so that the take-up string always engages the periphery of one of the dual pulley sections and the bowstring always engages the periphery of the other dual pulley section. The bowstring tension produces torque on its pulley section balancing the torque produced by the take-up string tension on its pulley section of the same composite pulley means, and the proportions of the pulley sections are designed so that the leverages of the take-up string tension and of the bowstring tension require a substantially constant draw force to be exerted on the bowstring over at least approximately one-third of the bowstring nocking point draw displacement in order to draw the bow.

BRIEF DESCRIPTION OF THE DRAWINGS

FIG. 2 is an enlarged detail perspective of a tip portion of a bow limb showing pulley means mounted thereon.

FIG. 3 is a top perspective of the pulley means separate from the bow, and FIG. 4 is an exploded top perspective of such pulley means.

FIG. 5 is a transverse section through the pulley means taken on line 5—5 of FIG. 3.

FIG. 6 is a diagrammatic elevation of the pulley means showing components thereof separated.

DETAILED DESCRIPTION

Figure 1:
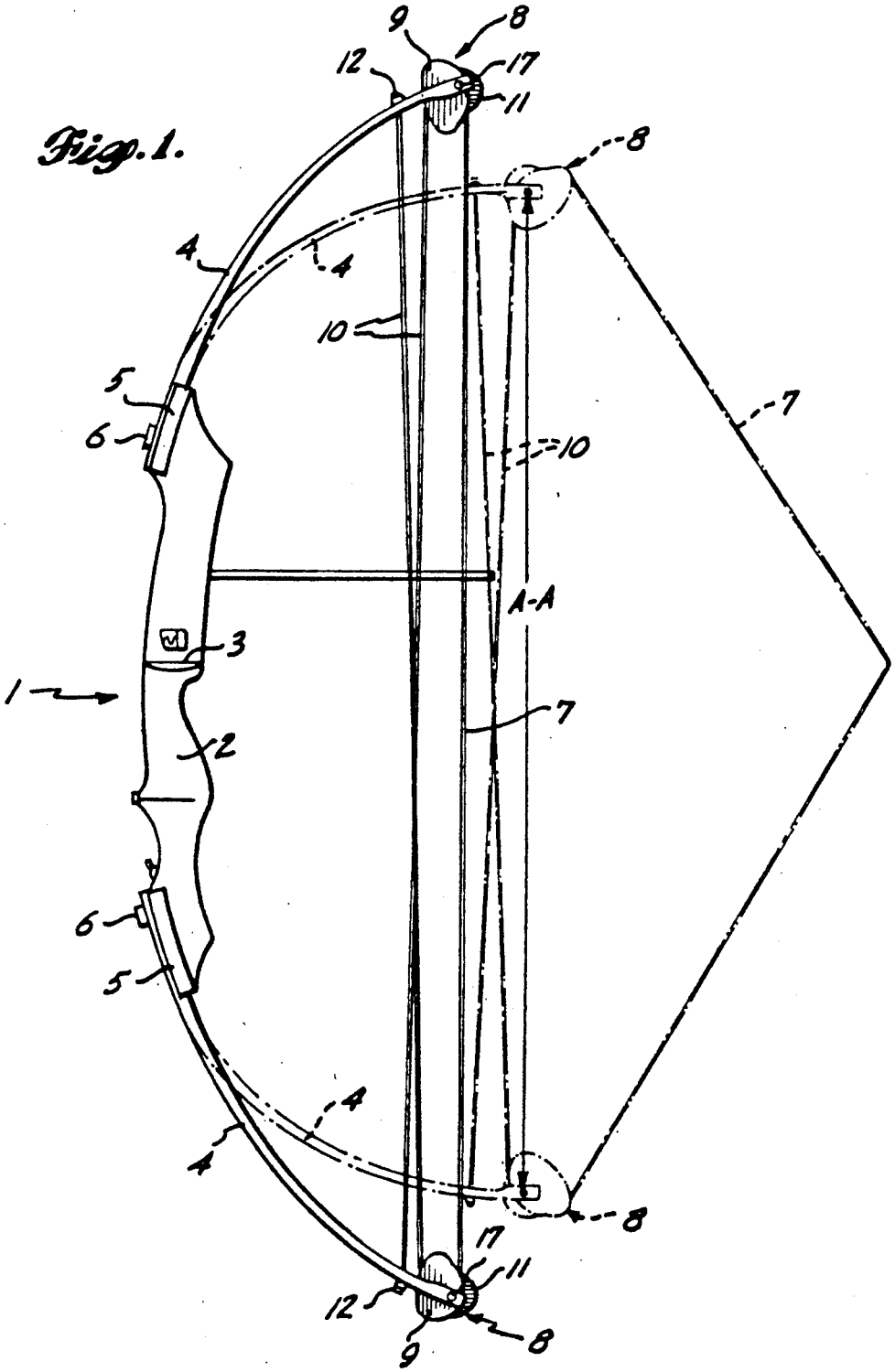
FIG. 1 is a side elevation of a compound archery bow in accordance with the present invention.

The general construction of the compound bow with which the pulleys of the present invention are used may be substantially the same as the compound bows shown in the U.S. patents of Allen, U.S. Pat. No. 3,486,495, Kudlacek, U.S. Pat. No. 4,060,066, Barna, U.S. Pat. No. 4,202,316 and Jennings, U.S. Pat. No. 4,241,715, except for the type of pulley means mounted on the bow limb tip portions.

The handle member 1 has a grip 2 located immediately below the arrow rest or ledge 3. The root ends of limbs 4 projecting oppositely from the opposite end portions of the handle member 1 are retained on the handle member seats 5 by screws 6. The bowstring 7 connects composite cam pulleys 8 mounted on the tip portions of the respective limbs 4. Such bowstring engages the bowstring cam pulley sections 9 of the composite pulleys. Take-up strings 10 engage the take-up string cam pulley sections 11 of the composite pulleys 8. Each take-up string extends between the take-up string pulley section on the tip portion of one bow limb and an anchor 12 on the opposite bow limb.

As shown in FIGS. 3, 5 and 6, the bowstring 7 and the two take-up strings 10 are all part of a single string which embraces each of the bowstring pulley section 9 and the take-up string pulley section 11 and extends through a passage extending generally diametrically through the composite pulley and having a portion 13 connected to the groove in the bowstring pulley section and a portion 14 connected to the groove in the take-up string pulley section, which portions are substantially in alignment as shown in FIG. 6. A portion of the string between such passage portions 13 and 14 can be fixed to the composite pulley by setscrews 15 as shown best in FIG. 5.

Each composite pulley 8 can be received in a slot 16 in the tip portion of a limb 4 which slot opens at the end of the limb tip. The composite pulley can be mounted in such slot by an axle 17 extending through a bearing passage 18 in the composite pulley for free turning of such pulley on the axle. For convenience of manufacture, the bowstring pulley section 9 and the take-up string pulley section 11 can be fabricated separately and secured in proper rotative relationship by connecting bolts or screws 19 so as to form an integral composite pulley structure. Alternatively the composite pulley can be molded as a unit in plastic such as acetol resin or cast or machined as a unit in metal such as an aluminum alloy.

A guard rod 20 may extend from the handle member 1 toward and into overlapping relationship with the take-up strings 10 and the bowstring 7 when the bowstring is in its straight condition so as to hold the take-up strings laterally out of the path of movement of the arrow during shooting.

As in other compound bows, one function of the composite pulleys 8 is to enable the limbs of the bow to be held in the bent full draw position shown in broken lines in FIG. 1 by exerting on the bowstring 7 a draw force less than the force required at some intermediate portion of the draw to draw the bow. The purpose for requiring only a smaller draw force to hold the bow in fully drawn condition is to enable the archer to take more time for aiming and to aim under less stress than is occasioned by shooting a longbow where the required draw force increases progressively during the draw and is maximum at full draw. Conventionally, the draw force required to hold a compound bow at full draw is within the range of 50 percent to 70 percent of the maximum draw force necessary to draw the bow. Thus, for example, if the maximum draw force during the draw is 65 pounds, the draw force required to hold the bow in fully drawn position would be in the range of 32 to 45 pounds.

The principal objective of the present invention is to drive a selected arrow as far and as fast as possible with a compound bow having a predetermined maximum draw force, a predetermined full draw holding force and a predetermined bowstring nocking point draw displacement. The arrow is driven by energy imparted to the nock of the arrow by the bowstring engaged with it in straightening from its bent fully drawn position. The energy which is transferred from the bowstring to the arrow cannot be greater than the potential energy stored in the bent bow limbs, and the proportion of such stored energy which is transferred from such bow limbs to the arrow reflects the efficiency of the bow. The bow efficiency is usually in the range of 70 percent to 80 percent depending upon the amount of energy lost in friction between the arrow and the arrow rest, friction between the pulley means and the pulley axles and the energy required to accelerate moving parts of the bow rigging such as turning of the pulley means relative to the bow tip portions and unbending of the bow limbs.

While for any particular compound bow somewhat more energy can be imparted to the arrow by making operation of the bow more efficient so that a greater proportion of the potential energy stored in the bent bow limbs will be transformed into kinetic energy of the arrow, only a limited increase in the amount of energy transmitted to the arrow can be effected by increasing the bow efficiency. The most practical way to impart more kinetic energy to the arrow, therefore, is to increase the amount of potential energy stored by the bow limbs.

The amount of potential energy stored in the bow limbs is entirely the result of the work performed by the archer on the bowstring in drawing it. Such work or energy is the direct result of the amount of force applied to the bowstring by the archer and the distance that the nocking point of the bowstring is displaced during which such force is applied to the bowstring in drawing the bow. There is a practical limit to the maximum force that can be exerted by the archer on the bowstring because of physical limitations of the archer, a typical maximum force being 65 pounds. Also, there are practical limits to the amount of the bowstring nocking point displacement that can be effected during the draw because of the finite arm length of the archer.

Consequently, the only practical way to maximize the storage of kinetic energy in the bent bow limbs is to require exertion of the greatest draw force at each stage of the draw without sacrificing manipulative benefits of the compound bow such as providing for a draw force at full draw which is substantially less than the maximum draw force required during some portion of the draw. The compound bow of the present invention is able to maximize the potential energy stored by the bent bow limbs 4 by utilizing a bowstring pulley 9 and a take-up string pulley 11 having profiles that will require maximum draw force to be exerted over more than one-third, such as approximately 37 percent or 38 percent, of the total bowstring nocking point draw displacement.

The profile of each bowstring section 9 of the composite pulley 8 is the mirror image of the profile of the other composite pulley bowstring pulley section. Similarly, the profile of each take-up string cam pulley section 11 is the mirror image of the other composite pulley take-up pulley section. Moreover, as shown in FIG. 1, the bowstring pulley sections 9 of the composite pulleys 8 carried by the two bow limbs are on one side of the central plane of the bow and the take-up string pulley sections 11 of the two composite pulleys 8 are on the other side of such central plane. Consequently, the bowstring 7 will be disposed in a plane perpendicular to the two composite pulley axles 17 and at the same side of the bow central plane as the bowstring pulley sections 9, while the take-up strings 10 will be offset from such bowstring plane and will cross each other.

As shown in FIG. 1, during drawing of the bow the bowstring nocking point located substantially centrally between the bow limb tip portions will be displaced rearwardly away from the handle member 1 to bend the initially straight bowstring. The origin of the limb-bending force is the pull exerted by the archer on the nocking point of the bowstring but the actual pull exerted on each bow limb tip portion has three components, namely, the pulling force component exerted by the bowstring 7 on the bowstring pulley 9 mounted on that limb tip portion, the pulling force exerted by the take-up string 10 that wraps into the peripheral groove of the take-up string pulley section 11 mounted on that limb tip portion and the pulling force exerted by the other take-up string connected to that bow limb tip portion by the anchor 12. The bowstring 7 bends at the nocking point progressively more as the nocking point is displaced away from the handle section until the bow limbs reach the attitude shown in broken lines in FIG. 1, but, as also shown in FIG. 1, the take-up strings 10 remain straight in all bent positions of the bow limbs.

Figure 7:
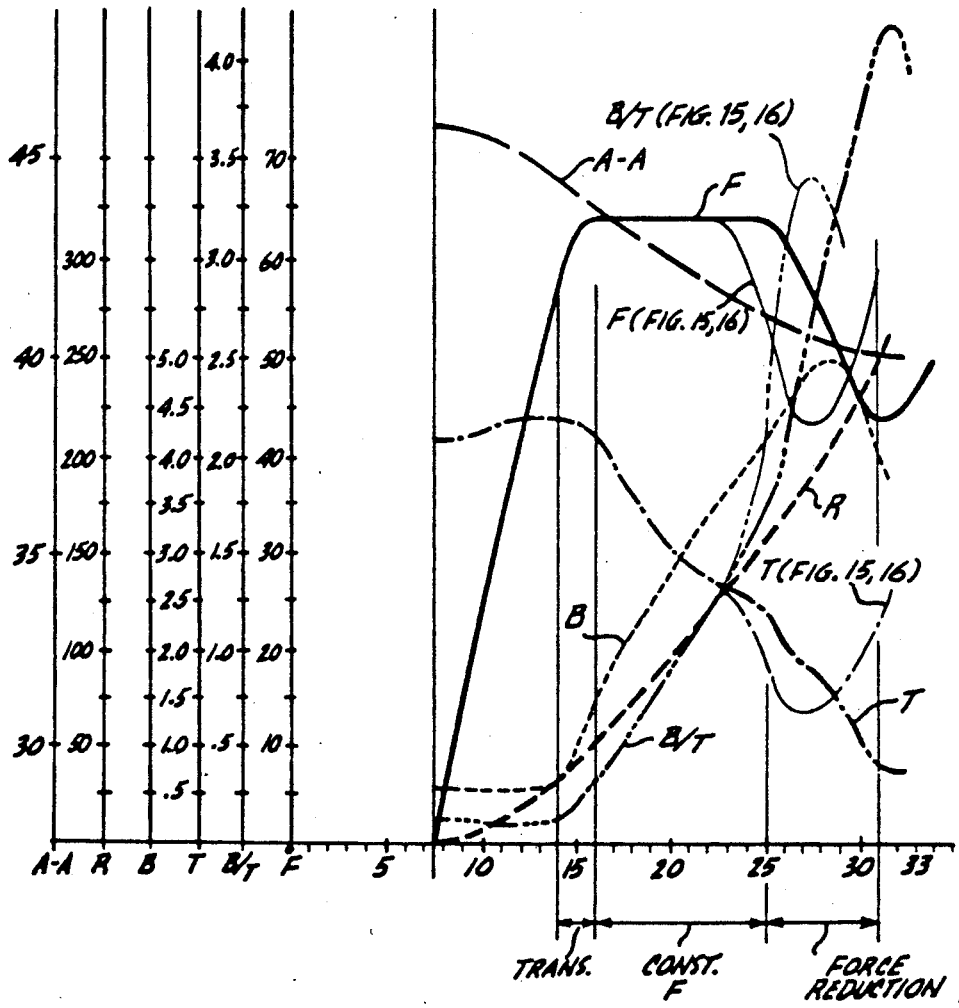
FIG. 7 is a graph representing various characteristics of the bow of the present invention.

As the tip portions of the bow limbs bend toward each other from their positions when the bowstring is straight, the distance between the bow limb tip portions, the spacing A—A between the axles 17 indicated in FIG. 1, decreases as indicated by the curve AA in FIG. 7. The lengths of the two take-up strings 10 simultaneously decrease correspondingly. In order for the length of the take-up strings to be reduced, they must wrap to a greater extent around the take-up string pulley sections 11, which is effected by turning of the composite pulleys 8. Since the composite pulleys are free to turn, such take-up string wrapping action must be accomplished by turning of the compound pulleys effected by torque exerted by the bowstring 7 on the bowstring cam pulley section 9 greater than the opposing torque produced by take-up string 10 on the take-up string cam pulley section 11 of the same composite pulley 8. The turning of the composite pulley therefore depends upon progressive unbalancing of the bowstring torque and of the take-up string torque on the composite pulley resulting from incipient relaxing of tension in the take-up string as the bow limbs bend to reduce the distance between them.

At any instant that composite pulley 8 is stationary, the torque produced on the composite pulley by the bowstring pulling force acting on the bowstring pulley section 9 is equal to the torque produced by the take-up string 10 acting on the take-up string pulley section 11. At any instant while the composite pulley 8 is turning, that turning is in a direction and to an extent such that the torque produced by the pulling force exerted by the take-up string 10 on the take-up pulley section 11 seeks to equal the torque produced by the pulling force exerted by the bowstring 7 on the bowstring pulley section 9. In each instance, the torque produced on the composite pulley 8 is obtained by multiplying together the pulling force of the string and the length of the lever arm between the axis of axle 17 and the string pulling force line perpendicular to the pulling force direction. Consequently, the shorter the lever arm the greater must be the pulling force to produce a given balancing torque on the composite pulley.

As discussed above, in order to maximize the storage of kinetic energy in the bent bow limbs it is desirable to require the pulling force on the bowstring to be a substantially constant maximum value over the greatest practical portion of the bowstring draw displacement, taking into consideration the inability of the draw force to reach its maximum value instantaneously and the desirability of the draw force being substantially less than the maximum draw force at full draw. The problem of controlling the draw force so that a constant maximum force will be required over a large portion of the drawstring draw displacement, such as more than one-third of such displacement, is the fact that, as the draw proceeds, the force required to bend a bow limb farther increases progressively instead of being constant.

Also, the effectiveness of the pull of the bowstring on a bow limb to bend the limb changes because such force is most effective when the bowstring is perpendicular to the tip portion of the bow limb. During a bow-drawing sequence the angle between the bow limb tip portion and the drawstring first is acute, progressively increases to a right angle and during further draw of the bow such angle becomes obtuse. Such change in angular relationship between the bow limb and the bowstring complicates the relationship between the pulling force exerted by the bowstring and the progressively increasing force required to bend the bow limb.

The draw force of the bowstring always equals twice the component of the bowstring tension which is perpendicular to the bowstring when it is straight. This component increases continuously as the draw sequence progresses and the included angle between the bowstring parts at opposite sides of the nocking point decreases.

In addition, the relationship between the force required to bend the bow limb and the bowstring pulling force is complicated because, as has been discussed above, the pulling force exerted on the tip portion of the bow limb to bend it is produced not only by the bowstring, but also by the take-up string engaged with the take-up string pulley section 11 and by the take-up string anchored to the bow limb tip portion.

The present invention utilizes the correlation between the groove profile of the bowstring cam pulley section 9 and the groove profile of the take-up string cam pulley section 11 to alter the lengths of the bowstring pulling force lever arm and the take-up string pulling force lever arm about the axis of axle 17 to proportion the bowstring pulling force relative to the take-up string pulling force. During the initial portion of the draw, the bowstring pulling force will be required to increase as rapidly as possible, then, as the draw progresses, when the bowstring pulling force has increased to the desired maximum, such maximum bowstring pulling force will be maintained substantially constant until it is desired to reduce the bowstring pulling force as the maximum displacement of the bowstring nocking point is approached. Moreover, the bowstring cam pulley section and the take-up string cam pulley section are designed to obtain a reasonably abrupt transition between the substantially linearly increasing bowstring pulling force portion of the draw and the constant maximum pulling force portion of the draw.

To illustrate the relationship between the bowstring draw force and the displacement of the bowstring nocking point, FIG. 7 has a curve F showing bowstring draw force or pulley force in pounds plotted against bowstring draw distance in inches. Draw distance is equal to the initial offset of the straight bowstring from the handle member plus the nocking point displacement during draw. This curve shows that the bowstring pulling force increases rapidly intially along a substantially straight steeply inclined line between approximately 7.5 and 16 inches (19.05 and 40.64 cm) of bowstring draw distance, i.e. 8.5 inches (21.59 cm) of nocking point displacement, and the bowstring pulling force is substantially constant between 16 inches (40.64 cm) and 25 inches (63.5 cm) of bowstring draw distance i.e. 9 inches (22.86 cm) of nocking point displacement, and then the bowstring pulling force decreases rapidly during the remaining 6.5 inches (16.5 cm) of the bowstring nocking point displacement to approximately 31.5 inches (80.00 cm) of bowstring draw distance. Thus, during the total displacement of the bowstring nocking point from 7.5 inches (19.95 cm) to 31.5 inches (80.00 cm) of bowstring draw distance, a distance of 24 inches (60.96 cm), the bowstring pulling force is building up during the first 8.5 inches (21.6 cm) or 35.4 percent of the nocking point displacement distance, remains constant for 9 inches (22.86 cm) or 37.5 percent of the nocking point displacement distance and is decreasing for 6.5 inches (16.51 cm) or 27.1 percent of the nocking point displacement from 25 inches (63.5 cm) to 31.5 inches (80.00 cm) of the draw distance.

Initially, the nocking point of the bowstring can be displaced a substantial distance with very little pulling effort. Consequently, during initial displacement of the nocking point, it is desirable for the bending force applied to the bow limb tip portions to be principally the force of the bowstring with the forces exerted on the bow limb tip portions by the take-up strings 10 being comparatively small. To obtain such force relationship, the bowstring lever arm B must be of minimum practical length and the take-up string lever arm T must be of maximum practical length. The minimum length of lever arm B is limited by the size of the axle 17 and the provision of a reasonable thickness of bearing pulley stock around the aperture 18 of the composite pulley through which the axle extends. The maximum length of the take-up string pulley section lever arm T is governed by the practical depth of the slot 16 in a tip end portion of the bow limb which receives the composite pulley.

By utilizing a practical minimum length of bowstring lever arm B and a practical maximum length of take-up string lever arm T, a ratio of B/T in the range of 0.1 to 0.4 results. The composite pulley illustrated in the drawings has an initial B/T ratio of 0.143.

It is desirable to maintain the bowstring arm length B substantially minimum until the bowstring draw force F has reached or approaches its maximum value and, during the same portion of the bowstring nocking point draw displacement, the take-up string lever arm T should be substantially maximum. During such portion of the nocking point displacement, however, the composite pulley must turn to some extent in order to maintain the take-up strings 10 taut as the tip end portions of the bow limbs move toward each other.

As the bowstring draw force F increases to approach its maximum desirable limit, the length of the bowstring lever arm B should increase so that a draw force F exceeding the maximum desired draw force will not be required. Because of the progressively increasing force required to bend the bow limbs as the draw progresses, the bowstring lever arm B also should increase progressively throughout the constant draw force portion of the draw to prevent the force required to draw the bow from becoming too great. Near the end of the draw, the bowstring lever arm B will decrease and it will continue to decrease beyond the desired full draw position.

As the bow limb tip portions are deflected toward each other during the initial portion of the draw, the effective depth of the bow limb end slots 16 in which the composite pulleys 8 are received increases somewhat. Consequently, the lever arm T of the take-up string can be increased slightly by increasing the radius of the take-up string cam pulley section 11 while maintaining the same clearance between the take-up string pulley section and the bottom of the slot 16. During the constant draw force portion of the draw, the take-up string lever arm T is reduced progressively in order to avoid the necessity for increasing the length of the bowstring lever arm B so rapidly for a given increase required in the ratio of B/T as the draw progresses. Beyond the constant draw force portion of the draw, the length of the take-up string lever arm T will decrease more rapidly in order to provide an accelerated increase in the B/T ratio.

Desirable exemplary values of bowstring lever arm B, take-up string lever arm T and the ratio of B/T are portrayed by the respective curves labeled B, T and B/T in FIG. 7 in which values are plotted against draw distance. Ordinates have been drawn on this graph representing the following conditions:

(1) the straight position of the bowstring,
(2) the beginning of the transition of the draw force from a steep, substantially straight line, draw force increasing condition to a phase where the maximum draw force is approached,
(3) the beginning of the constant draw force section of the curves,
(4) the end of the constant draw force section of the curves, and
(5) the full draw position of the curves.

The bowstring lever arm B is shown as increasing from 0.6 to 0.7 cm (about ¼ inch) during the linearly increasing F portion of the curve, increasing from 0.7 to 1.6 cm (¼ to ⅝ inches) during the transition portion of the curve to constant F, increasing substantially linearly from 1.6 cm (⅝ inch) to 4.3 cm (1⅝ inches) during the constant F portion of the draw and decreasing from 4.3 cm (1⅝ inches) to 3.8 cm (1½ inches) during the force-reducing or let-off portion of the draw. Certainly during the bowstring force increasing portion of the draw the bowstring lever arm B should not increase more than 20 percent. The effective length of the bowstring lever arm B should increase at least 150 percent during that portion of the bowstring draw displacement in which the draw force required is at least 90 percent of the maximum draw force required to draw the bowstring during draw.

The take-up string lever arm T increases slightly from 4.2 to 4.4 cm (1⅝ to 1¾ inches) during the straight line draw force increasing portion of the draw, decreases from 4.4 cm (1¾ inches) to 4.25 cm (1⅝ inches) during the transition portion of the draw, decreases generally linearly but at a somewhat progressively decreasing rate from 4.25 cm (1⅝ inches) to 2.5 cm (1 inch) during the constant bowstring force portion of the draw and then decreases more rapidly from 2.5 cm (1 inch) to 0.9 cm (⅜ inch) during the let-off portion of the draw. Certainly during the bowstring force increasing portion of the draw the take-up string lever arm should not decrease in value more than 20 percent. The effective length of the take-up string lever arm T should decrease at least 40 percent during that portion of the bowstring draw displacement in which the draw force required is at least 90 percent of the maximum draw force required to draw the bowstring during draw.

The change in the bowstring lever arm B and in the take-up string lever arm T results in the configuration of the B/T curve increasing slightly from 0.143 to 0.16 during the linear increasing force portion of the draw, a smooth increase from 0.16 to 0.38 during the transition portion of the draw to constant F, a substantially linear increase from 0.38 to 1.72 during the constant F portion of the draw and a more rapid increase from 1.72 to 4.22 during the let-off portion of the draw. Throughout almost the entire draw force buildup phase of the draw the B/T ratio is less than 20 percent of the maximum B/T ratio which occurs at full draw, and preferably less than 10 percent of the maximum B/T ratio, and may be less than 5 percent of the maximum B/T ratio. The B/T ratio should increase at least 300 percent during that portion of the bowstring draw displacement in which the draw force required is at least 90 percent of the maximum draw fore required to draw the bowstring during draw.

By increasing the length of the bowstring lever arm B and decreasing the length of the take-up string lever arm T progressively during the constant F portion of the draw, the periphery of the bowstring pulley section 9 and of the take-up string pulley section 11 can be curved progressively to avoid both substantially flat sections and sharply curved sections. Substantially flat sections could result in the bowstring escaping from the groove of the bowstring cam pulley 9, or at least slapping the pulley groove, during shooting. Sections curved too sharply could cause fatigue in cable constituting the string.

Also, such proportioning of the bowstring lever arm B and of the take-up string lever arm T results in nearly uniform turning of each composite pulley relative to the bow limb tip portion on which it is mounted throughout the draw, as indicated by the curve R in FIG. 7 which represents the angular movement of the composite pulleys relative to the handle of the bow during the draw. The rate at which the composite pulleys turn during the transition phase of the draw is somewhat greater than during the linearly increasing force portion of the draw, and the rate of turning of the composite pulleys during the constant force portion of the draw and the let-off portion of the draw is somewhat greater than during the transition portion of the draw.

It is preferred that the composite pulley 8 rotate relative to the handle portion of the bow during the full draw in the range of 7/12 (210 degrees) to 9/12 (270 degrees) of a revolution depending on the size of the pulley sections, the length of the bow limbs and the displacement of the nocking point of the bowstring during draw or the draw length. The composite pulley 8 shown in FIGS. 10 to 14 turns through an angle relative to the handle of the bow of approximately 17/24 of a revolution or 253 degrees.

Figures 10, 11, 12, 13, 14:
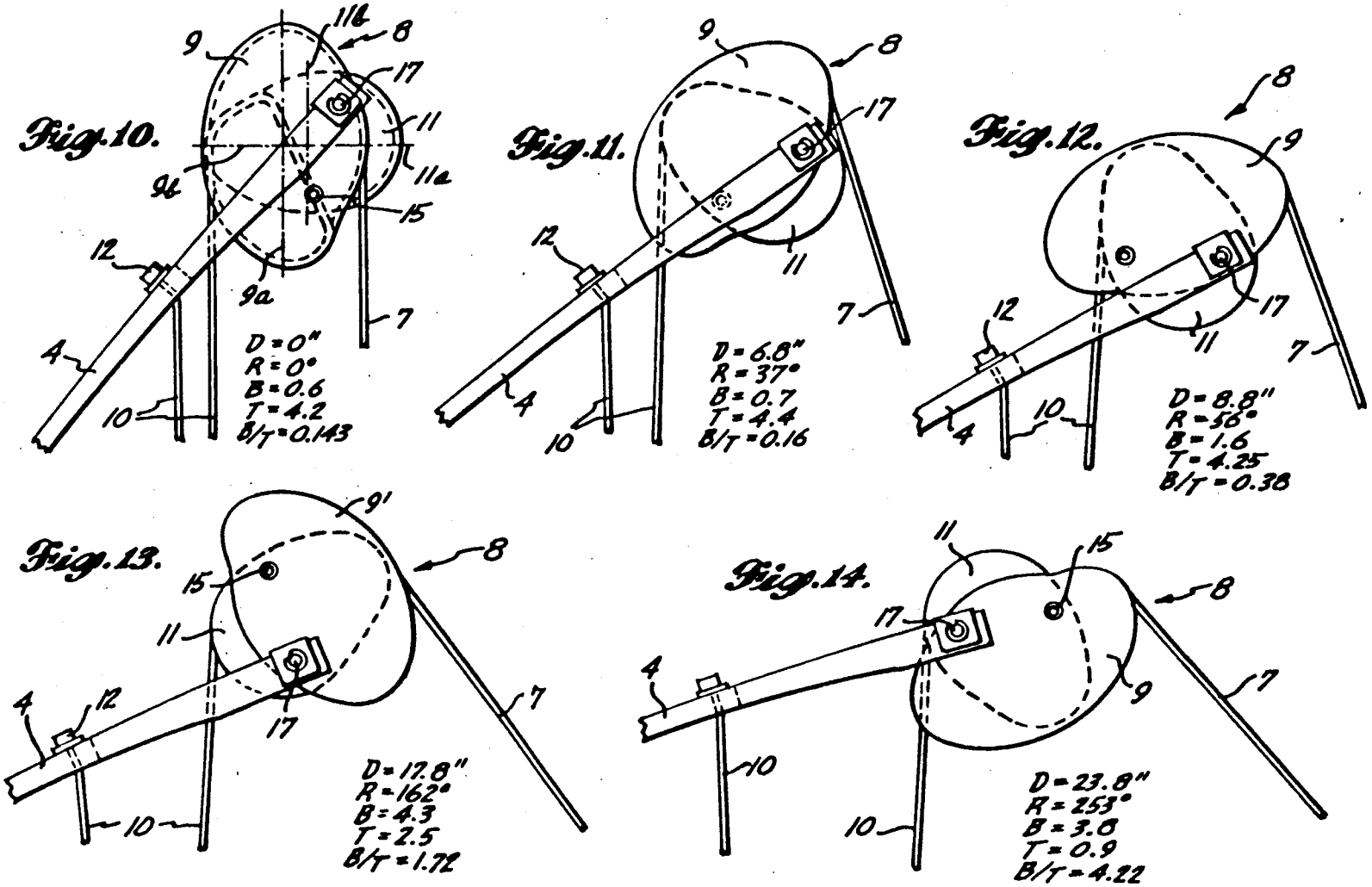
FIGS. 10 to 14, inclusive, are side elevations of a tip portion of a compound archery bow limb having composite pulley means according to the present invention mounted thereon showing such bow limb tip in various deflected positions and such pulley means in different corresponding rotative positions.

At the beginning of the draw, the bowstring 7 is straight and substantially parallel to the take-up strings 10, as shown in FIGS. 1 and 10. FIG. 11 shows the composite pulley 8 in the position corresponding to the beginning of the transition phase of the draw from the straight line increasing force toward the constant F line of FIG. 7. In that position the composite pulley has turned through about 37 degrees relative to the handle portion of the bow. FIG. 12 shows the composite pulley turned farther to the beginning of about the constant F phase of the bow draw by which time the composite pulley has turned through an angle of about 56 degrees relative to the handle portion of the bow. At the end of the constant force phase of the draw the composite pulley has turned through an angle of about 162 degrees relative to the handle portion of the bow, as shown in FIG. 13. By the time the bowstring 7 has been drawn to the full draw position shown in broken lines in FIG. 1, the composite pulley has turned through about 253 degrees relative to the handle portion of the bow, as shown in FIG. 14.

The changes in the length of the bowstring lever arm, the changes in the length of the take-up string lever arm and the changes in the B/T ratio must take into consideration the progressively increasing resistance of the bow limbs to bending as they are deflected during draw, the changing angle between the bowstring portions at opposite sides of the nocking point and the limb tip portions during the limb deflection, and the increasing horizontal component of the bowstring tension. The desired progressive changes in the length of the bowstring lever arm B and in the length of the take-up string lever arm T are accomplished by selection of the appropriate profiles for the groove of the bowstring cam pulley section 9 and of the take-up string cam pulley section 11, the proportion of the pulley section profiles which are active during draw, that is, those portions of the pulleys on which the string wraps or unwraps, the relative angular disposition of the bowstring pulley section profile and the take-up string pulley section profile and the location of the turning axis established by the axle 17.

Figure 8:
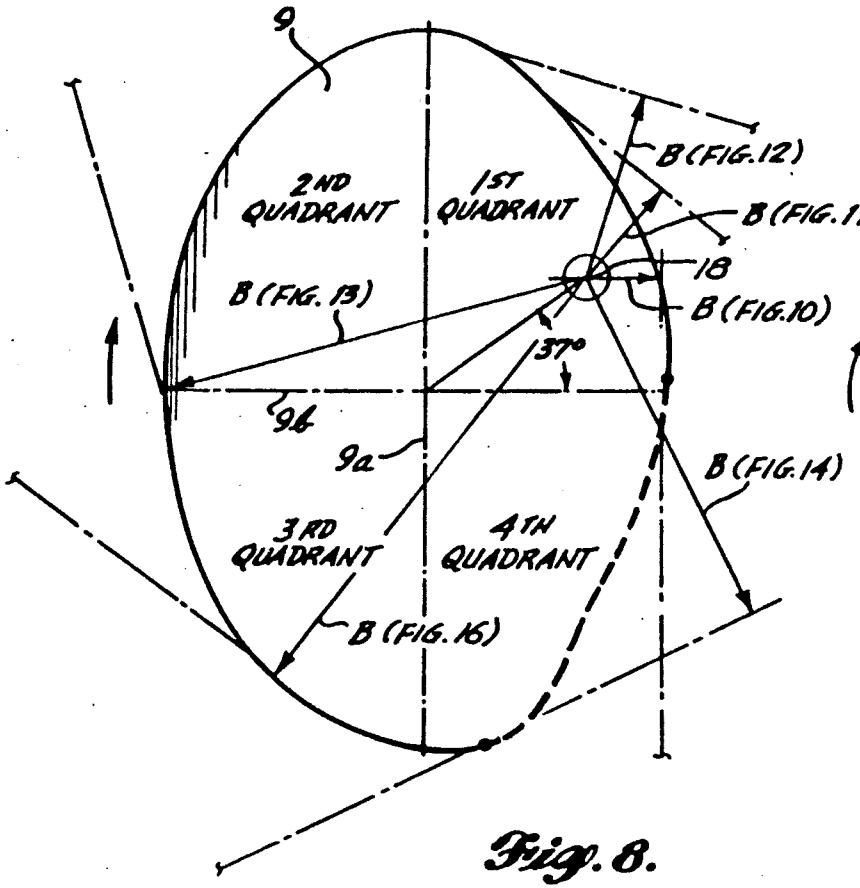
FIG. 8 is an enlarged side elevation representing the profile of one pulley section component of a composite pulley means of the present invention.

As shown diagrammatically in FIG. 8, the profile of the bowstring pulley section groove bottom is generally planar and noncircular, being generally, particularly the solid line portion which represents the active portion of the pulley groove. This pulley section is indicated as having a major axis or major profile dimension straight line 9*a* passing through the portion of the pulley of substantially greatest length and the central portion of the pulley section, and a minor axis or minor profile dimension straight line 9*b* substantially perpendicularly bisecting the major axis and passing through the portion of the pulley of substantially greatest width. These axes define in sequence a first quadrant, a second quadrant and a third quadrant designated progressively in a counter-clockwise direction to correspond to the sequence of the quadrants from which the bowstring unwinds during draw of the bow as the pulley rotates in a clockwise direction. The peripheral shape of the fourth quadrant is largely immaterial but it should be such as to avoid sharp bends in the portion of the pulley periphery around which the bowstring is wrapped as indicated in FIG. 6.

Figure 9:
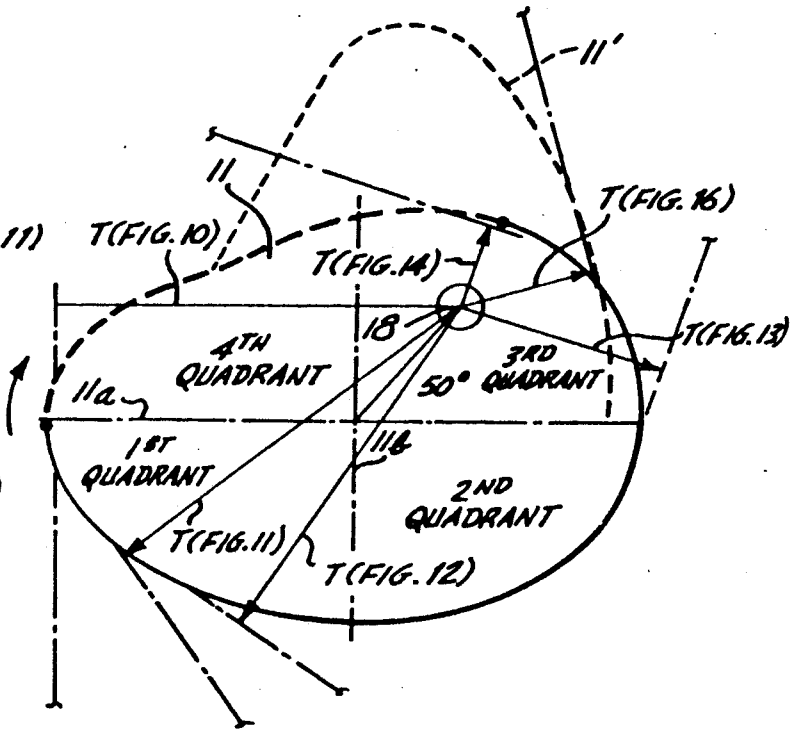
FIG. 9 is a similar elevation representing the other pulley component of the composite pulley means.

The profile of the bottom of the groove periphery of the take-up string pulley section 11 shown diagrammatically in FIG. 9 is also generally planar and noncircular, having a periphery of generally elliptical shape with respect to its active portion, although it can be of somewhat oval shape depending on the profile of the inactive portion of the periphery shown in broken lines. In this figure have been shown a major axis 11*a* passing through substantially the greatest length of the pulley and a minor axis 11*b* perpendicularly bisecting the major axis. Again, the active quadrants are labeled first quadrant, second quadrant, third quadrant and fourth quadrant in a counterclockwise sequence representing the sequence in which take-up string is wound onto the pulley as it rotates clockwise during draw of the bow.

The major axis 9*a* of the bowstring pulley 9 is longer than the major axis 11*a* of the take-up string pulley section 11; the major axis 11*a* of the take-up string pulley section is longer than the minor axis 9*b* of the bowstring pulley section; and the minor axis 9*b* of the bowstring pulley section is longer than the minor axis 11*b* of the take-up string pulley section. In each of the pulleys the length of the minor axis is approximately two-thirds of the length of the major axis. The length of the major axis 11*a* of take-up pulley section 11 is approximately 80 percent of the length of the major axis 9*a* of the bowstring pulley section 9.

FIG. 10 shows the bowstring pulley section 9 and the take-up string pulley section 11 integrated into a unit by being directly combined in parallel side by side noncoincident relationship which they occupy whether the composite pulley is constructed in two sections that are assembled or is manufactured as a unitary article. In such integrated relationship the planes perpendicular to the respective pulley sections in which the major axes of the two sections lie cross at a substantial angle, preferably being substantially mutually perpendicular. As shown, they are mutually perpendicular so that when the bowstring 7 is straight, the minor axis 9*b* of the bowstring pulley section 9 is substantially with the major axis 11*a* of the take-up string pulley section 11 in a plane perpendicular to the pulley section profiles, and the minor axis 11*b* of the take-up string pulley section 11 is substantially parallel to the major axis 9*a* of the bowstring pulley section 9 but is spaced from it away from the bow limb to such an extent that the end of the bowstring pulley section minor axis 9*b* is substantially aligned with the end of the major axis 11*a* of the take-up string pulley section 11 remote from the bowstring 7 and adjacent to the bow limb. When the bowstring is straight the major axis 9*a* of the bowstring pulley section 9 is substantially parallel to the bowstring so that it is essentially vertical when the bow is being held vertically with the bowstring undrawn.

The axle-receiving aperture 18 is in the first quadrant of the bowstring pulley section 9 and in the third quadrant of the take-up string pulley section 11, which quadrants are farthest from the bow handle when the bowstring 7 is straight, as shown in FIG. 10. Thus the axle 17 pivot axis of the composite pulley 8 is spaced a substantial distance from the major axis of at least one pulley section and preferably is offset from the major axes of both pulley sections, as shown in FIG. 10. The turning or pivot axis of the composite pulley coinciding with the center of the axle-receiving aperture 18 is located angularly generally centrally of its quadrant, being disposed along a line making an angle of at least about 40 degrees with one of the perpendicularly crossing major axes. When the bowstring is straight the bow limb tip portion substantially bisects the angle between the major axes of the bowstring pulley section 9 and the take-up string pulley section 11 as shown in FIG. 10.

During draw of the bow through a bowstring draw displacement of about 24 inches (61 cm), the bowstring pulley section 9 rotates clockwise through the successive positions shown in FIGS. 11, 12, 13 and 14 turning a total angle of about 253 degrees relative to the bow handle and the bowstring unwinds considerably from the bowstring pulley section groove. The bowstring lever arms in each of such positions are shown in FIG. 8. At the end of the constant draw force phase of the draw the major axis 9*a* of the bowstring pulley section 9 is again substantially parallel to the adjacent stretch of the bowstring as shown in FIG. 13.

When the bowstring is straight, as shown in FIG. 10, the major axis of the take-up string pulley section 11 is substantially perpendicular to the bowstring. As the bow is drawn, the take-up string pulley section 11 turns successively through the positions shown in FIGS. 11, 12, 13 and 14 relative to the bow limb tip portion during which turning each take-up string is wound onto the periphery of a take-up string pulley section 11 so as to maintain the take-up strings taut despite the bending of the bow limb tip portions toward each other, as indicated in dot-dash lines in FIG. 1. The take-up string lever arms for each of such positions are shown in FIG. 9.

If the bow limbs are shorter, or if they are stiffer, it will not be necessary for as much take-up string length to be wound onto the take-up string pulley sections 11 during the draw and, consequently, such pulley sections can be made smaller for a given bowstring nocking point draw displacement. Such draw displacement can, however, be increased or decreased without changing the maximum force required to draw the bow merely by changing a portion of the profile contour of the take-up string pulley section 11. Such change in profile will result in shifting the position of the beginning of the let-off portion of the bowstring force curve one direction or the other so as to decrease or to increase the amount of the nocking point draw displacement at full draw and correspondingly the length of the constant force portion of curve F.

Figure 16:
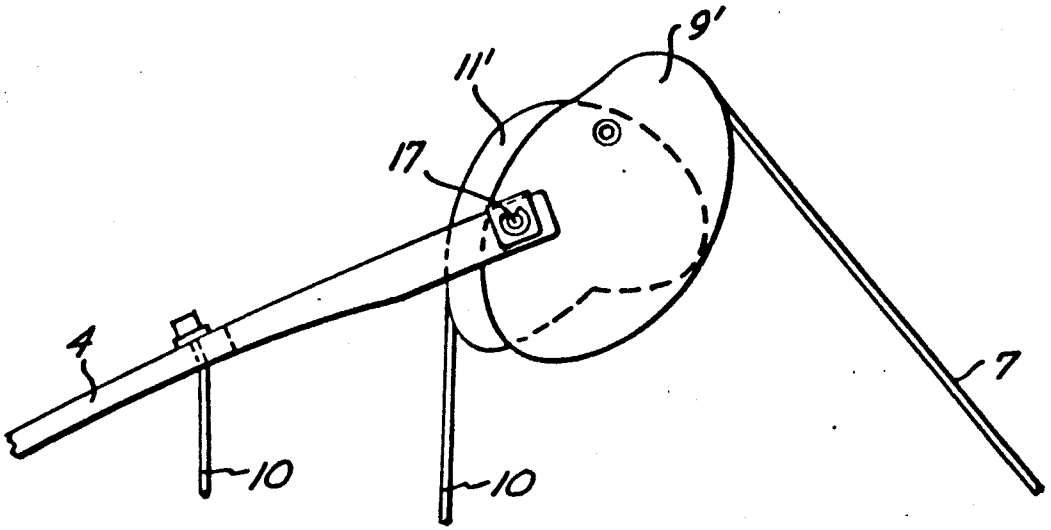
FIGS. 15 and 16 are side elevations of the tip portion of a compound archery bow limb having mounted thereon modified composite pulley means according to the present invention, the deflection of the bow limb and the rotative position of the composite pulley means corresponding, respectively, to the conditions of FIGS. 10 and 14.
Figure 15:
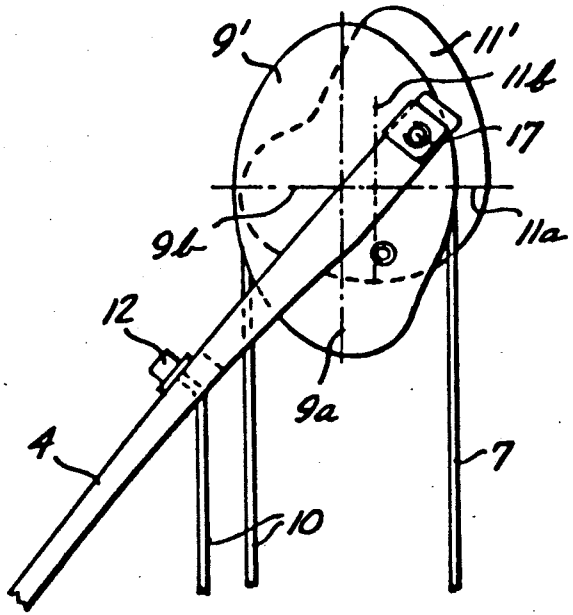

FIGS. 15 and 16 show a composite pulley in which the shape and position of the bowstring pulley section 9' is the same as that of bowstring pulley section 9 shown in FIGS. 10 to 14. In the instance of FIGS. 15 and 16, however, the profile of part of the second quadrant and the third quandrant of take-up string cam pulley section 11' has been altered from the profile of pulley section 11 shown in dot-dash lines in FIG. 9 so that the take-up pulley section lever arm decreases more rapidly than where the take-up string pulley section has the profile shown in FIGS. 10 to 14. A change in contour of the third quadrant of the take-up string cam can also be made to change the amount of draw force reduction during let-off in addition to, or instead of, changing only the draw length.

The alteration in profile of the take-up string cam section 11' as shown in FIGS. 15 and 16 results in the take-up string lever arm decreasing to a greater extent during the latter portion of the draw, as indicated in the T' section of the T curve shown in FIG. 7. Such reduction in the take-up string lever arm results in an earlier reduction in the draw force F' of the substantially constant maximum value, as indicated in the portion F' of the F curve shown in FIG. 7. The entire let-off action of the bow occurs at a shorter draw length so that, as shown in FIG. 7, such draw length is decreased from 31½ inches (80 cm) to 27 inches (68.6 cm) reducing the total bowstring draw displacement from 24 inches (61 cm) to 19½ inches (49.6 cm) and the substantially constant maximum draw force portion of the draw from 9 inches (22.86 cm) to 6½ inches (16.5 cm) of bowstring draw displacement.

In the instance of the composite cam pulley of FIGS. 10 to 14, however, the extent of the substantially constant maximum draw force portion of the draw represents 37½ percent of the total nocking point draw displacement, while the 6½ inches (16.5 cm) constant force portion of a bow draw having a composite pulley of the type shown in FIGS. 15 and 16 and a maximum bow draw displacement of 19½ inches (29.6 cm) represents only 33⅓ percent of the nocking point draw displacement. In the instance of the composite cam pulley of FIGS. 15 and 16, the total pulley rotation relative to the bow handle during draw is approximately 196 degrees or about 7/12 of a turn instead of about 17/24 of a turn as where the composite pulley shown in FIGS. 10 to 14 is used. It is preferred that the minimum turn of the composite pulley be at least about 200 degrees relative to the handle of the bow because a draw length less than about 27 inches (68.6 cm) results in a bow which can store less than the desired amount of potential energy as compared to a bow having a greater draw length.

In general, it is desired that the characteristics of the composite pulley used in the compound bow of the present invention result in the draw force building up along a steep substantially straight line to at least 80 percent, and preferably to approximately 90 percent, of the maximum nocking point draw displacement value over a bowstring draw displacement of 25 percent to 35 percent of the total bowstring draw displacement, and that the maximum draw force be maintained substantially constant throughout a bowstring draw displacement proportion of 30 percent to 50 percent of the total bowstring draw displacement. The transition from substantially straight line draw force buildup to substantially constant maximum draw force should occur in 5 to 15 percent of the total bowstring draw displacement. The let-off or draw force decreasing final portion of the draw should occur in a range of 20 percent to 30 percent of the total bowstring draw displacement.

During buildup of the draw force to 90 percent of the maximum draw force, the composite pulley rotates through at least 10 percent, and preferably approximately 15 percent, of its maximum rotation during the draw. Such rotation should be at least 30 degrees and preferably 35 to 45 degrees. During the substantially constant maximum force phase of the draw, the rotation of the composite pulley should be from 35 percent to 45 percent of the bowstring draw displacement, and preferably about 40 percent of the bowstring draw displacement.

Because the bowstring pulley section 9 and the take-up string pulley section 11 are offset from the central plane of the bow, the pull of the bowstring on its pulley section and the pull of the take-up string on its pulley section tend to twist the bow limbs oppositely. As has been explained above, during the initial portion of the draw the pull on the bowstring is much greater than the pull on the take-up string. At first neither pull is very strong because the pulling force required to bend the bow initially is not very great. During the constant draw force phase of the draw, however, when the composite pulleys are between the position of FIG. 12 and the position of FIG. 13, the pull of the bowstring is much greater than the pull of the take-up string and, because such pulling force is offset from the central plane of the bow, such force tends to twist the bow limbs. If the periphery of the bowstring pulley section engaged by the bowstring is considerably curved, however, as shown in FIG. 13, the twisting of the bow limbs which may occur does not prevent the bowstring from tracking reliably in the bowstring pulley section groove during shooting of the arrow.

I claim:

1. An archery compound bow composite pulley comprising a generally planar noncircular bowstring cam pulley section and a generally planar noncircular take-up string cam pulley section, substantially the entire peripheral profile of said noncircular take-up string pulley section being of a shape different from the shape of the peripheral profile of said noncircular bowstring cam pulley section, and integrating means directly combining said bowstring cam pulley section and said take-up string cam pulley section in parallel side-by-side relationship for forming a unit with substantially the entire peripheries of said pulley sections being out of registration.

2. An archery compound bow composite pulley comprising a generally planar noncircular bowstring cam pulley section having a major axis extending through substantially its greatest length and lying in a plane which is perpendicular to said generally planar bowstring cam pulley section, a generally planar noncircular take-up string cam pulley section having a major axis extending through substantially its greatest length and lying in a plane which is perpendicular to said generally planar take-up string cam pulley section, and integrating means directly combining said bowstring cam pulley section and said take-up string cam pulley section in parallel side-by-side relationship for forming a unit with the major axes perpendicular planes of said two pulley sections crossing substantially mutually perpendicularly.

3. In the composite pulley defined in claim 2, the integrating means combining the bowstring cam pulley section and the take-up string cam pulley section with the major axis of the take-up string cam pulley section substantially bisecting the major axis of the bowstring cam pulley section.

4. In the composite pulley defined in claim 3, the bowstring cam pulley section having a minor axis, the integrating means combining the bowstring cam pulley section and the take-up string cam pulley section with the minor axis of the bowstring cam pulley section substantially perpendicularly bisecting the major axis of the bowstring cam pulley section and with the major axis of the take-up string cam pulley section being disposed substantially coplanar with the minor axis of the bowstring cam pulley section.

5. In the composite pulley defined in claim 4, the integrating means combining the bowstring cam pulley section and the take-up string cam pulley section with one end of the bowstring cam pulley section minor axis substantially in registration with one end of the take-up string cam pulley section major axis.

6. In the composite pulley defined in claim 2, the take-up string cam pulley section having a minor axis substantially perpendicularly intersecting the major axis of the take-up string cam pulley section, the bowstring cam pulley section and the take-up string cam pulley section being disposed with said minor axis of the take-up string cam pulley section substantially parallel to and spaced from the major axis of the bowstring cam pulley section.

7. An archery compound bow composite pulley comprising a generally planar noncircular bowstring cam pulley section having a major axis extending through substantially its greatest length and lying in a plane which is perpendicular to said generally planar bowstring cam pulley section and a minor axis disposed substantially perpendicular to said major axis, a generally planar noncircular take-up string cam pulley section having a major axis extending through substantially its greatest length and lying in a plane which is perpendicular to said generally planar take-up string cam pulley section and a minor axis disposed substantially perpendicular to said take-up string cam pulley major axis, the minor axis of said take-up string cam pulley section being substantially shorter than the minor axis of said bowstring cam pulley section, and integrating means directly combining said bowstring cam pulley section and said take-up string cam pulley section in parallel side-by-side relationship for forming a unit.

8. In the composite pulley defined in claim 7, the length of the major axis of the take-up string cam pulley section being approximately 80 percent of the length of the major axis of the bowstring cam pulley section.

9. In the composite pulley defined in claim 7, the bowstring cam pulley section minor axis being of a length approximately two-thirds of the length of the major axis of the bowstring cam pulley section.

10. In the composite pulley defined in claim 7, the take-up string cam pulley section minor axis being of a length approximately two-thirds of the length of the major axis of the take-up string cam pulley section.

11. An archery compound bow composite pulley comprising a generally planar generally elliptical bowstring cam pulley section having a major axis extending through substantially its greatest length and lying in a plane which is perpendicular to said generally planar bowstring cam pulley section, a generally planar generally elliptical take-up string cam pulley section having a major axis extending through substantially its greatest length and lying in a plane which is perpendicular to said generally planar take-up string cam pulley section, and integrating means directly combining said bowstring cam pulley section and said take-up string cam pulley section in parallel side-by-side relationship for forming a unit with the major axes perpendicular planes of said two pulley sections crossing substantially mutually perpendicularly, and pivot means defining a turning axis extending transversely of said pulley sections at a location offset substantially equidistantly from both of the pulley section major axes.

12. An archery compound bow composite pulley comprising a generally planar noncircular bowstring cam pulley section, a generally planar noncircular take-up string cam pulley section, and integrating means directly combining said bowstring cam pulley section and said take-up string cam pulley section in parallel side-by-side relationship for forming a unit, said bowstring cam pulley section and said take-up string cam pulley section being constructed for effecting a bowstring lever arm means effective length which increases at least 150 percent, a take-up string lever arm means effective length which decreases at least 40 percent and a ratio of the effective length of the bowstring lever arm means to the effective length of the take-up string lever arm means which increases at least 300 percent while the draw force is at least 90 percent of the maximum draw force during displacement of the bowstring nocking point over a distance of at least one-third of the total displacement of the bowstring nocking point during draw.

13. Two pulley means for an archery compound bow including a handle member, two resilient limbs carried by and projecting oppositely substantially symmetrically from the handle member and mounting the two pulley means on their tip portions, respectively, for turning about an axis relative to the handle member, a bowstring extending between the two pulley means and a take-up string engaged with each pulley means, the improvement comprising each pulley means including a generally planar noncircular bowstring cam pulley section engaged by the bowstring and a generally planar noncircular take-up string cam pulley section engaged by a take-up string, and integrating means directly combining said bowstring cam pulley section and said take-up string cam pulley section of each pulley means in parallel side-by-side relationship for forming a unit, said bowstring cam pulley section and said take-up string cam pulley section of each pulley means being constructed for effecting a bowstring lever arm means effective length which increases at least 150 percent, a take-up string lever arm means effective length which decreases at least 40 percent and a ratio of the effective length of the bowstring lever arm means to the effective length of the take-up string lever arm means which increases at least 300 percent while the draw force is at least 90 percent of the maximum draw force during displacement of the bowstring nocking point during draw.

14. Two pulley means for an archery compound bow including a handle member, two resilient limbs carried by and projecting oppositely substantially symmetrically from the handle member and mounting the two pulley means, respectively, on their tip portions for turning about an axis relative to the handle member, a bowstring extending between the two pulley means and a take-up string engaged with each pulley means, the improvement comprising each pulley means including a generally planar noncircular bowstring cam pulley section engaged by the bowstring and a generally planar noncircular take-up string cam pulley section engaged by a take-up string, and integrating means directly combining said bowstring cam pulley section and said take-up string cam pulley section of each pulley means in parallel side-by-side relationship for forming a unit, said bowstring cam pulley section and said take-up string cam pulley section of each pulley means being constructed for effecting a bowstring lever arm means effective length which increases substantially linearly, a take-up string lever arm means the effective length of which decreases substantially and a ratio of the effective length of said bowstring lever arm means to the effective length of said take-up string lever arm means which increases substantially linearly as the bowstring nocking point is displaced during draw while the draw force is at least 90 percent of the maximum draw force.

15. Two pulley means for an archery compound bow including a handle member, two resilient limbs carried by and projecting oppositely substantially symmetrically from the handle member and mounting the two pulley means, respectively, on their tip portions for turning about an axis relative to the handle member, a bowstring extending between the two pulley means and a take-up string engaged with each pulley means, the improvement comprising each pulley means including a generally planar noncircular bowstring cam pulley section engaged by the bowstring and a generally planar noncircular take-up string cam pulley section engaged by a take-up string, and integrating means directly combining said bowstring cam pulley section and said take-up string cam pulley section of each pulley means in parallel side-by-side relationship for forming a unit, said bowstring cam pulley section and said take-up string cam pulley section of each pulley means being constructed for effecting a bowstring lever arm means effective length which increases substantially and a take-up string lever arm means effective length which decreases substantially as the nocking point is displaced during draw while the draw force is at least 90 percent of the maximum draw force.

16. An archery compound bow composite pulley comprising a generally planar generally elliptical bowstring cam pulley section having a major axis extending through substantially its greatest length and lying in a plane which is perpendicular to said generally planar bowstring cam pulley section, a generally planar generally elliptical take-up string cam pulley section having a major axis extending through substantially its greatest length and lying in a plane which is perpendicular to said generally planar take-up string cam pulley section, and integrating means directly combining said bowstring cam pulley section and said take-up string cam pulley section in parallel side-by-side relationship for forming a unit with said major axis perpendicular plane of said bowstring cam pulley section and said major axis perpendicular plane of said take-up string cam pulley section crossing substantially mutually perpendicularly.

17. In the composite pulley defined in claim 16, the take-up string cam pulley section being sufficiently smaller than the bowstring cam pulley section that the length of the major axis of the take-up string cam pulley section is approximately 80 percent of the length of the major axis of the bowstring cam pulley section.

18. In the composite pulley defined in claim 16, the integrating means combining the cam pulley sections of each pulley means with the major axis perpendicular plane of the take-up string cam pulley section substantially bisecting the major axis of the bowstring cam pulley section.

19. In the composite pulley defined in claim 16, the bowstring cam pulley section having a minor axis perpendicularly bisecting the major axis of the bowstring cam pulley section, and the integrating means combining the cam pulley sections with the major axis of the take-up string cam pulley section substantially coplanar with the minor axis of the bowstring cam pulley section and with one end of the bowstring cam pulley section minor axis being substantially in registration with one end of the take-up string cam pulley section major axis.

20. An archery compound bow composite pulley comprising a generally planar generally elliptical bowstring cam pulley section having a major axis extending through substantially its greatest length and lying in a plane which is perpendicular to said generally planar bowstring cam pulley section and a minor axis disposed substantially perpendicular to said major axis, a generally planar generally elliptical take-up string cam pulley section having a major axis extending through substantially its greatest length and lying in a plane which is perpendicular to said generally planar take-up string cam pulley section and a minor axis disposed substantially perpendicular to said take-up string cam pulley major axis, said take-up string cam pulley section being sufficiently smaller than said bowstring cam pulley section that said minor axis of said take-up string cam pulley section is substantially shorter than said minor axis of said bowstring cam pulley section, and integrating means directly combining said bowstring cam pulley section and said take-up string cam pulley section in parallel side-by-side relationship for forming a unit.

21. An archery compound bow composite pulley comprising a generally planar noncircular bowstring cam pulley section, a generally planar noncircular take-up string cam pulley section, substantially the entire peripheral profile of said noncircular take-up string pulley section being of a shape different from the shape of the peripheral profile of said noncircular bowstring cam pulley section, and integrating means directly combining said bowstring cam pulley section and said take-up string cam pulley section in parallel side-by-side relationship for forming a unit.

22. An archery compound bow composite pulley comprising a generally planar noncircular bowstring cam pulley section, a generally planar noncircular take-up string cam pulley section, and integrating means directly combining said bowstring cam pulley section and said take-up string cam pulley section in parallel side-by-side relationship for forming a unit, said bowstring cam pulley section having bowstring lever arm means and said take-up string cam pulley section having take-up string lever arm means for first increasing the force required to draw the bowstring and subsequently for decreasing the force required to draw the bowstring during draw, the effective length of the bowstring lever arm means acting while the draw force is increasing always being less than 20 percent of the length of the maximum bowstring lever arm means.

23. In the composite pulley defined in claim 22, the bowstring cam pulley section and the take-up string cam pulley section being constructed for effecting a ratio of the effective length of the bowstring lever arm means to the effective length of the take-up string lever arm means during the force-increasing phase of the draw which is always less than 10 percent of the maximum ratio of bowstring lever arm means to take-up string lever arm means during draw of the bow.

24. In the composite pulley means defined in claim 22, the bowstring cam pulley section and the take-up string cam pulley section being constructed for effecting a ratio of the effective length of the bowstring lever arm means to the effective length of the take-up string lever arm means during the force-increasing phase of the draw which is always less than 5 percent of the maximum ratio of bowstring lever arm means to take-up string lever arm means during draw of the bow.

25. In the composite pulley defined in claim 22, the bowstring cam pulley section and the take-up string cam pulley section being constructed for effecting a ratio of the effective length of the bowstring lever arm means to the effective length of the take-up string lever arm means which is within the range of 0.1 to 0.3 during the force-increasing phase of the draw.

26. In the composite pulley defined in claim 22, the bowstring cam pulley section and the take-up string cam pulley section being constructed for effecting a bowstring lever arm means effective length which does not change more than 20 percent and a take-up string lever arm means effective length which does not change more than 20 percent during the force-increasing phase of the draw to a value which is at least 80 percent of the maximum draw force.

27. In the composite pulley defined in claim 22, the bowstring cam pulley section and the take-up string cam pulley section being constructed for effecting a bowstring lever arm means effective length which does not change more than 10 percent and a take-up string lever arm means effective length which does not change more than 10 percent during the force-increasing phase of the draw to a value which is at least 80 percent of the maximum draw force.

28. In the composite pulley defined in claim 27, the bowstring cam pulley section and the take-up string cam pulley section being constructed for effecting a ratio of the effective length of the bowstring lever arm means to the effective length of the take-up string lever arm means which does not change more than 10 percent during increase in the draw force to a value which is at least 80 percent of the maximum draw force.

29. Two pulley means for an archery compound bow including a handle member, two resilient limbs carried by and projecting oppositely substantially symmetrically from the handle member and mounting the two pulley means, respectively, on their tip portions for turning about an axis relative to the handle member, a bowstring extending between the two pulley means and a take-up string engaged with each pulley means, the improvement comprising each pulley means including a generally planar noncircular bowstring cam pulley section engaged by the bowstring and a generally, planar noncircular take-up string cam pulley section engaged by a take-up string, and integrating means directly combining said bowstring cam pulley section and said take-up string cam pulley section of each pulley means in parallel side-by-side relationship for forming a unit, said bowstring cam pulley section and said take-up string cam pulley section of each pulley means being constructed for effecting a draw force of the bow which is increased to at least 90 percent of the maximum draw force of the bow during draw by displacement of the nocking point of the bowstring to an extent less than one-half of the total nocking point displacement during draw of the bow.

30. In the pulley means defined in claim 29, the bowstring cam pulley section and the take-up string cam pulley section of each pulley means being constructed for effecting a draw force of the bow which is increased to at least 90 percent of the maximum draw fore of the bow during draw by displacement of the nocking point of the bowstring to an extent less than 40 percent of the total nocking point displacement during draw of the bow.

31. Two pulley means for an archery compound bow including a handle member, two resilient limbs carried by and projecting oppositely substantially symmetrically from the handle member and mounting the two pulley means, respectively, on their tip portions for turning about an axis relative to the handle member, a bowstring extending between the two pulley means and a take-up string engaged with each pulley means, the improvement comprising each pulley means including a generally planar noncircular bowstring cam pulley section engaged by the bowstring and a generally planar noncircular take-up string cam pulley section engaged by a take-up string, and integrating means directly combining said bowstring cam pulley section and said take-up string cam pulley section of each pulley means in parallel side-by-side relationship for forming a unit, said bowstring cam pulley section and said take-up string cam pulley section of each pulley means being constructed for effecting a draw force of the bow which increases substantially linearly to a value of at least 80 percent of the maximum draw force.

32. In the pulley means defined in claim 31, the bowstring cam pulley section and the take-up string cam pulley section of each pulley means being constructed for effecting a draw force of the bow which increases substantially linearly to a value of at least 95 percent of the maximum draw force.

33. In the pulley means defined in claim 31, the bowstring cam pulley section and the take-up string cam pulley section of each pulley means being constructed for effecting a draw force of the bow which increases substantially linearly to a value of at least 90 percent of the maximum draw force while the nocking point of the bowstring is displaced less than 40 percent of the total nocking point displacement during draw of the bow.

* * * * *

Disclaimer 5,040,520—David J. Nurney, Seattle, Wash. LIMB TIP CAM PULLEY FOR HIGH ENERGY ARCHERY BOW. Patent dated August 20, 1991. Disclaimer filed April 3, 1997, by the assignee, Precision Shooting Equipment, Inc.

The term of this patent shall not extend beyond the expiration date of Pat. No. 4,739,744.

*(Official Gazette,* June 17, 1997)